United States Patent [19]

Nadel

[11] Patent Number: 4,529,201

[45] Date of Patent: Jul. 16, 1985

[54] MULTI-FACETED SOLID GEOMETRICAL PUZZLE TOY

[76] Inventor: Ernest Nadel, 6100 Pinewood Rd., Oakland, Calif. 94611

[21] Appl. No.: 695,409

[22] Filed: Jan. 25, 1985

Related U.S. Application Data

[63] Continuation of Ser. No. 360,453, Mar. 22, 1982, abandoned.

[51] Int. Cl.[3] ..... A63F 9/08

[52] U.S. Cl. ..... 273/153 S

[58] Field of Search ..... 273/153 S, 155

[56] References Cited

U.S. PATENT DOCUMENTS

| | | | |
|---|---|---|---|
| 3,081,089 | 3/1963 | Gustafson | 273/155 X |
| 4,344,623 | 8/1982 | Isobe | 273/153 S |
| 4,473,228 | 9/1984 | Hart | 273/153 S |
| 4,474,376 | 10/1984 | Gustafson | 273/153 S |

FOREIGN PATENT DOCUMENTS

| | | | |
|---|---|---|---|
| 42695 | 12/1981 | European Pat. Off. | 273/153 S |
| 8104382 | 7/1981 | Fed. Rep. of Germany | 273/153 S |
| 2405077 | 5/1979 | France | 273/153 S |
| 55-8193 | 3/1980 | Japan | 273/153 S |
| WO81/01638 | 6/1981 | PCT Int'l Appl. | 273/153 S |

OTHER PUBLICATIONS

Buckingham Toys brochure, 1 page, Jan. 1, 1982.

*Primary Examiner*—Anton O. Oechsle

*Attorney, Agent, or Firm*—Harris Zimmerman; Howard Cohen

[57] ABSTRACT

A multi-faceted solid geometrical puzzle toy includes a generally spherical base member and a plurality of tile members secured to the exterior of the base member, each tile member comprising one facet of the solid. In one embodiment, a plurality of regular pentagonal members are secured to the sphere in equally spaced apart relationship, the pentagonal members being raised from the surface of the sphere. The tile members include flanges extending laterally from inner portions thereof to be retained between the base member and the pentagonal members in translatable fashion. The gaps between adjacent pentagonal members define tracks in which the tile members may translate. The tile members include planar outer faces having linear edge portions disposed to impinge upon like linear edge portions of adjacent tile members to define a regular polyhedron, such as an icosahedron. In another embodiment, the pentagonal members are rotatable, and the tile members are disposed between adjacent pentagonal members and are rotatable therewith. The latter embodiment may include planar tile members and pentagonal members to define a rhombicosidodecahedron, or it may include curved tile members and pentagonal members to define a spherical solid.

In another embodiment, the previously described icosahedron may be stellated by providing triangular pyramids on each of the tile faces of the icosahedron. In a special case, the stellation is in the form of a triakis icosahedron, which form allows the individual pyramids to be rotated about their apices. However, the pyramids may be made higher, thus precluding such rotation.

6 Claims, 24 Drawing Figures

MULTI-FACETED SOLID GEOMETRICAL PUZZLE TOY

This application is a continuation of application Ser. No. 360,453, filed Mar. 22, 1982, abandoned.

BACKGROUND OF THE INVENTION

In recent years there has been a renewed interest among the general public in geometrical puzzle toys. These toys generally comprise a solid object of some regular geometric shape such as a regular polyhedron. Portions of the solid object are usually rotatable in a few planes (such as three for a hexahedron or four for a tetrahedron), or translatable, so that the puzzle may be "solved"; i.e., surface features or surface indicia of the solid object may be brought into a predetermined relationship or juxtaposition.

The most popular of these puzzle toys is based on the simplest forms of regular polyhedra, such as the regular tetrahedron or hexahedron, with movement in a small number of planes. Although the solutions to such puzzles may initially appear to be incomprehensibly abstract, it has been shown that a few simple strategies, when correctly applied in reiterative fashion, will lead to a relatively quick solution to the puzzle with relatively little mental effort. Thus the essential attraction of a puzzle, the mental challenge to achieve a solution, is reduced in these prior art devices.

SUMMARY OF THE PRESENT INVENTION

The present invention generally comprises a geometrical puzzle toy which provides a far more complex geometrical situation and a far more complicated solution. One embodiment includes exterior pieces which are all symmetrical and identical as to shape, rotational and translational movement, and position which can be assumed. The present invention thus increases the challenge to those individuals who delight in intricate geometrical puzzles. The complexity of the present invention is due to the fact that it embodies the more involved geometries of higher order polyhedra, such as the icosahedron, the rhombicosidodecahedron, and the perfect sphere.

The invention is generally characterized as a multi-faceted solid geometrical puzzle toy which includes a generally spherical base member and a plurality of tile members secured to the exterior of the base member, each tile member comprising one facet of the solid. In one embodiment, a plurality of regular pentagonal members are secured to the sphere in equally spaced apart relationship, the pentagonal members being raised from the surface of the sphere. The tile members include flanges extending laterally from inner portions thereof to be retained between the base member and the pentagonal members in translatable fashion. The gaps between adjacent pentagonal members define tracks in which the tile members may translate. The tile members include planar outer faces having linear edge portions disposed to impinge upon like linear edge portions of adjacent tile members to define a regular polyhedron, such as an icosahedron. The tile members are also each provided with a ring extending inwardly toward the sphere and adapted to impinge upon the rings of adjacent tile members to maintain proper spacing therebetween. The rings or tile members may be shaped to permit translation and rotation of the tile members, or to permit only translation of the tile members in the network of tracks. In a further modification of this embodiment, the tile members may be provided with outwardly extending pyramids which multiply the complex geometrical appearance of the solid.

In another embodiment, the pentagonal members are rotatable, and the tile members are disposed between adjacent pentagonal members with the outer surfaces of both in edge-adjacent relationship. The tile members include lateral flanges which are retained beneath edge portions of the pentagonal members, and the tile members are rotatable in concert with adjacent pentagonal members. The latter embodiment may include planar tile members and pentagonal members to define a polyhedron such as a rhombicosidodecahedron, or it may include curved tile members and pentagonal members to define a spherical solid.

A BRIEF DESCRIPTION OF THE DRAWING

Figure 12A:
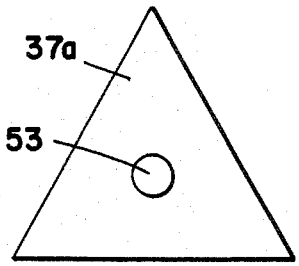
Figure 12B:
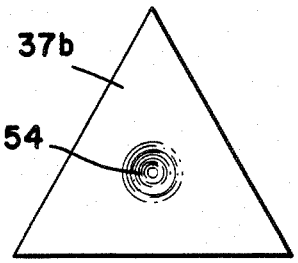
Figure 12C:
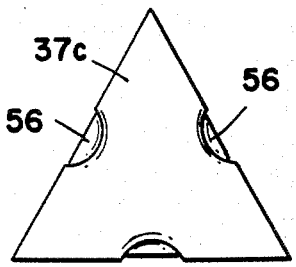

FIGS. 12*a*, 12*b*, and 12*c* are plan views of differing configurations of the tile members of the present invention.

Figure 1:
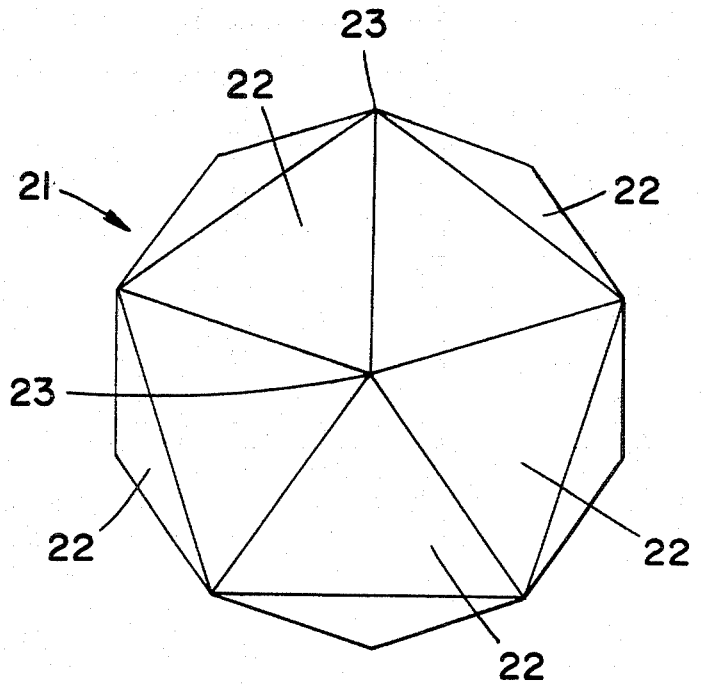
FIG. 1 is a plan view of the icosahedral embodiment of the puzzle toy of the present invention.
Figure 13:
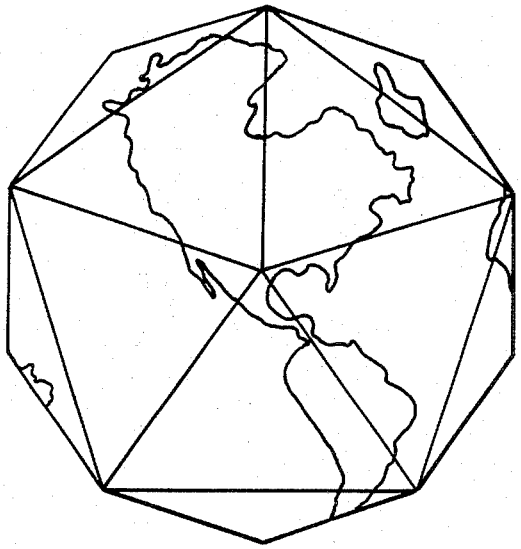

FIG. 13 is a perspective view of the embodiment depicted in FIG. 1, with each tile member including surface indicia corresponding to a portion of the surface of a globe.

Figure 14:
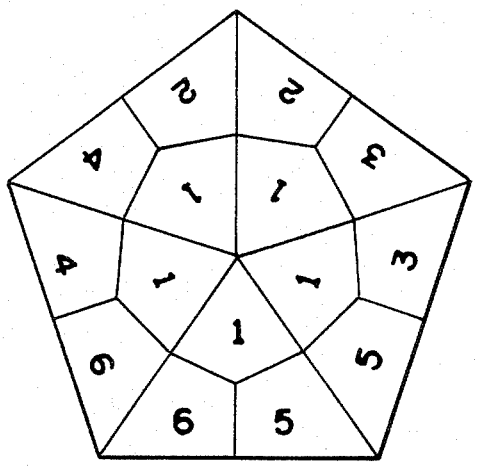

FIG. 14 is a plan view of the embodiment of FIG. 1, with each tile member including numerical indicia which may be brought into adjacent relationship about a common vertex.

Figure 15:
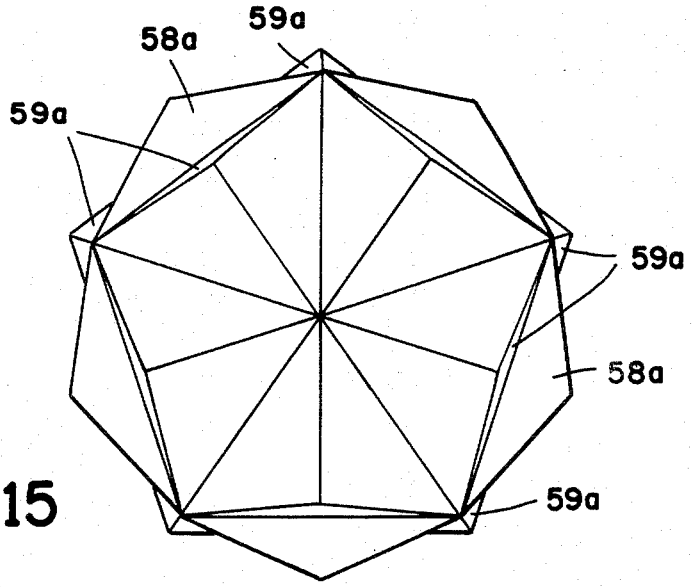

FIG. 15 is a plan view of a further embodiment fo the present invention, in which each tile members includes a radially outwardly extending pyramid to form a stellated icosahedron.

Figure 16:
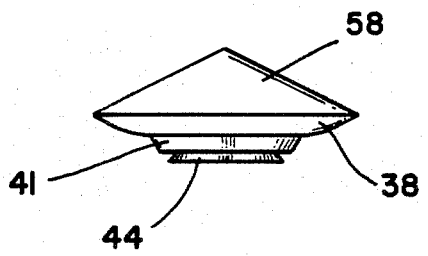

FIG. 16 is a plan view of a tile member of the embodiment depicted in FIG. 15.

Figure 17:
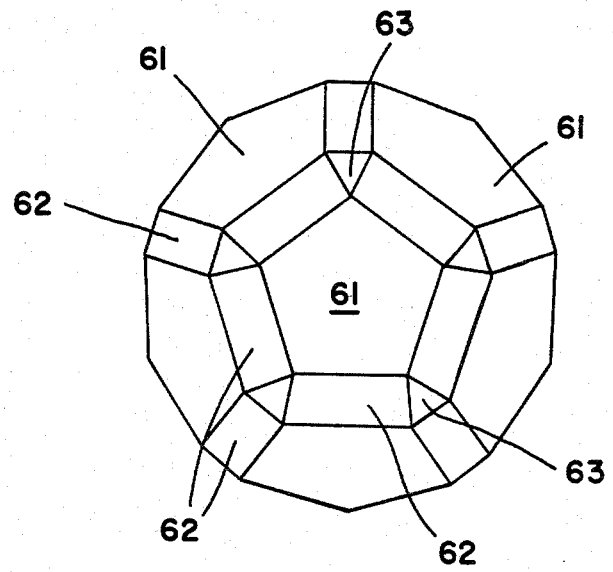

FIG. 17 is a plan view of a further embodiment of the present invention, which is configured as a rhombicosidodecahedron.

Figure 18:
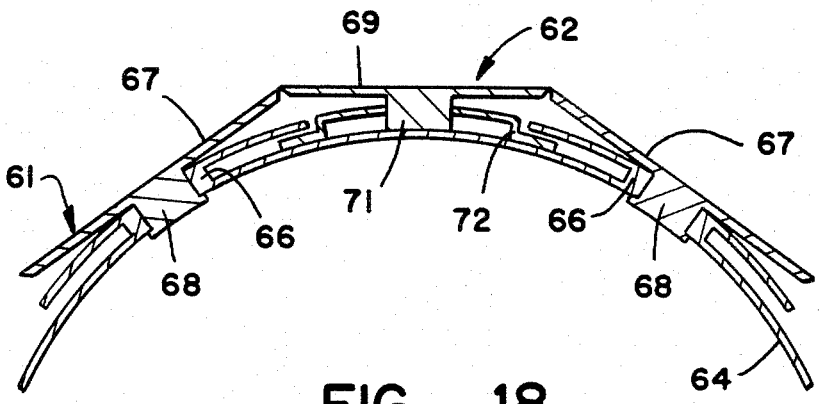

FIG. 18 is an enlarged cross-sectional view of the embodiment depicted in FIG. 17.

Figure 19:
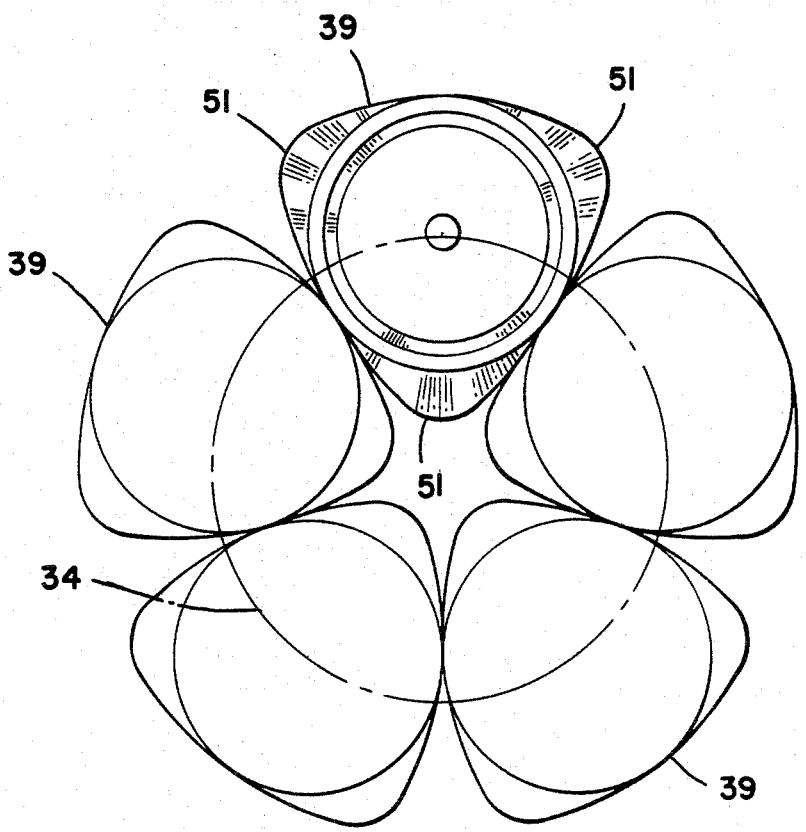

FIG. 19 is a further embodiment of the tile members of the puzzle of the present invention.

Figure 20:
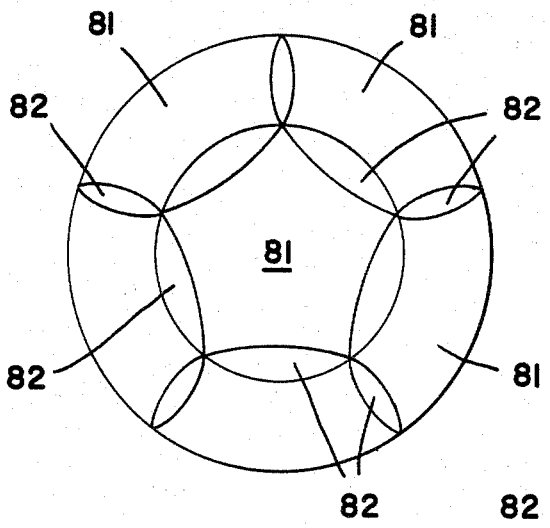

FIG. 20 is a plan view of a further, spherical embodiment of the present invention.

Figure 21:
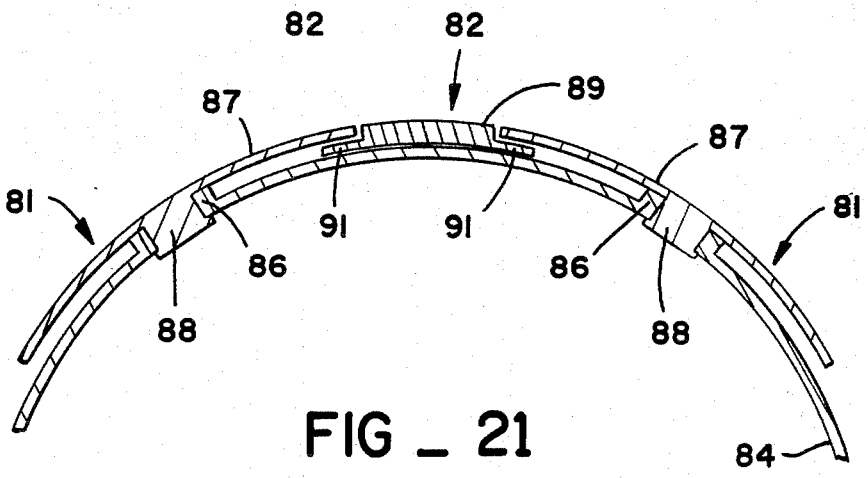

FIG. 21 is an enlarged cross-sectional view of the embodiment depicted in FIG. 20.

Figure 22:
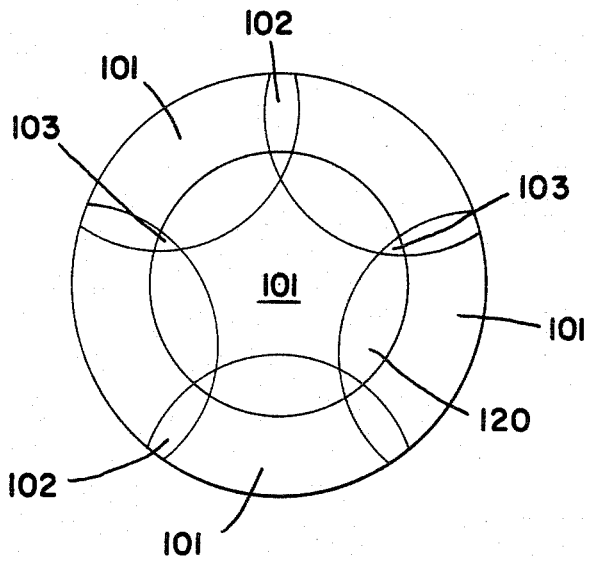

FIG. 22 is a plan view of a spherical embodiment of the present invention, including pentangular, lenticular, and triangular curved facets.

DESCRIPTION OF THE PREFERRED EMBODIMENT

The present invention generally comprises a multifaceted, solid geometrical puzzle toy in which individual facets of the polyhedron may be rotated and/or translated to effect a solution of the puzzle such that all of the facets are arranged with surface indicia thereon disposed in a predetermined and desired relationship.

Figure 2:
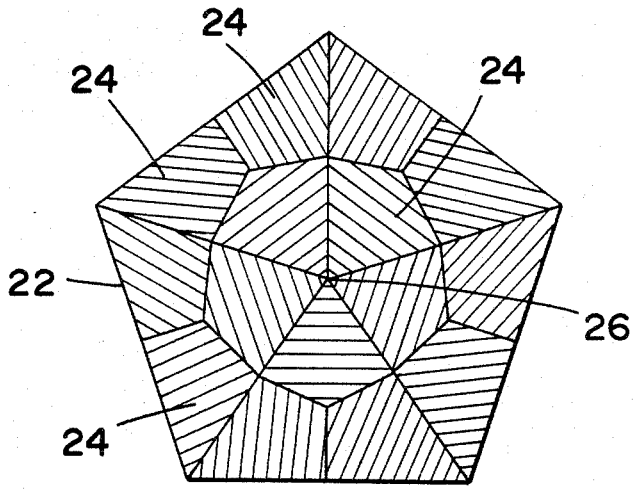
FIG. 2 is a plan view of the icosahedral embodiment of FIG. 1, with each facet including colored surface portions which may be brought into adjacent relationship.

With reference to FIGS. 1 and 2, one embodiment of the present invention comprises a puzzle 21 having an outer surface configuration of an icosahedron. In this embodiment the puzzle includes twenty outer facets 22, all of the facets 22 comprising identical triangles which are disposed in abutting edge relationship with adjacent facets. Each vertex 23 of the puzzle 21 is formed by the conjunction of the vertices of five of the facets 22. As shown in FIGS. 1 and 2, each vertex 23 is also the center of a pentagonal surface defined by the outer edges of the five triangular segments which join at that point. All of the facets 22 are translatable by rotation about any vertex 23 in concert with the four other facets 22 which also join at the particular vertex 23. Due to the fact that every facet 22 extends to three differing vertices 23, each facet may be rotated in conjunction with three differing groups of five facets each. By selective rotation of differing groups of facets, it is possible to move the facets about the outside of the solid figure to achieve a particular arrangement of the facets. For example, FIG. 2 depicts a color scheme for the facets 22 in which each facet is divided into three equal areas 24, each area 24 having a color which is dissimilar from the color of the adjacent two areas on the same facet 22. When the facets 22 are arranged in a random fashion about the surface of the icosahedron, the goal or solution of the puzzle is to arrange the facets so that five like-color segments 24 are disposed in adjacent relationship about a common vertex, for example vertex 26. Indeed, the total solution to the puzzle is achieved by orienting about each vertex of the icosahedron five like-color portions in adjacent relationship.

With reference to FIG. 13 the facets may alternatively be provided with indicia corresponding to portions of a geographic globe, the object of the puzzle being to arrange the facets in their proper relationship. Indeed, any spherical or near-spherical object, such as an autographed baseball, may provide the model for the indicia which is imprinted upon the surfaces of the tile members. In another version, depicted in FIG. 14, the facets may be provided with numerical indicia which must be manipulated into an arrangement of like numbers disposed about a common vertex.

Figure 3:
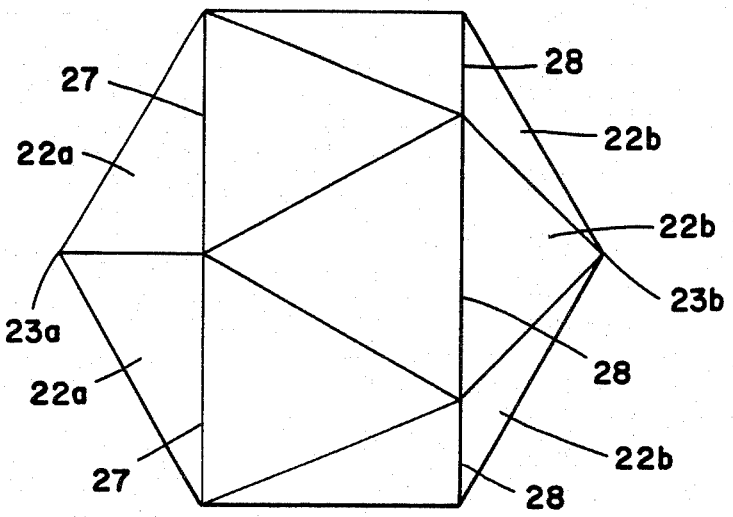
FIG. 3 is a plan view of the embodiment of FIGS. 1 and 2, shown rotated to display planes of symmetry.
Figure 4:
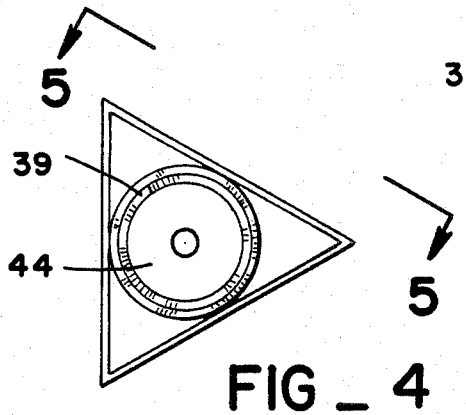
FIG. 4 is a bottom view of a tile member of the previous embodiments.
Figure 5:
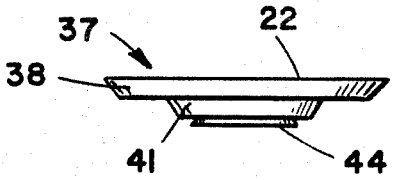
FIG. 5 is a plan elevation of the tile member of FIG. 4, taken along line 5—5 of FIG. 4.
Figure 6:
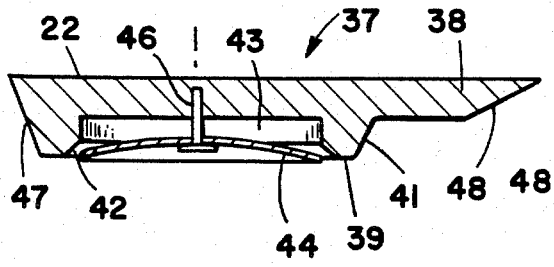
FIG. 6 is an enlarged cross-sectional elevation of a tile member of the present invention.
Figure 7:
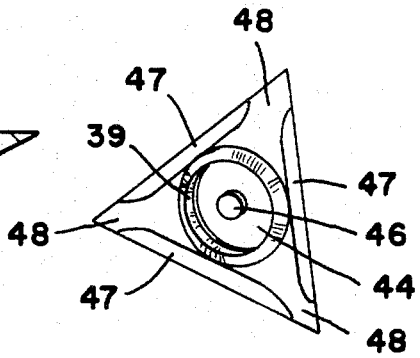
FIG. 7 is a bottom perspective view of a tile member of the present invention.

With reference to FIG. 3, the straight lines 27 and 28 comprise edge views of the planes in which the facets 22*a* and 22*b*, respectively, rotate. The axes of rotation pass through the vertices 23*a* and 23*b*, respectively. It may be appreciated that for each of the twelve vertices 23 there exists a plane in which the five segments which join at the vertex are rotatable as a group. Each plane is paired with a like plane in parallel alignment, as are planes 27 and 28, for example.

Figure 8:
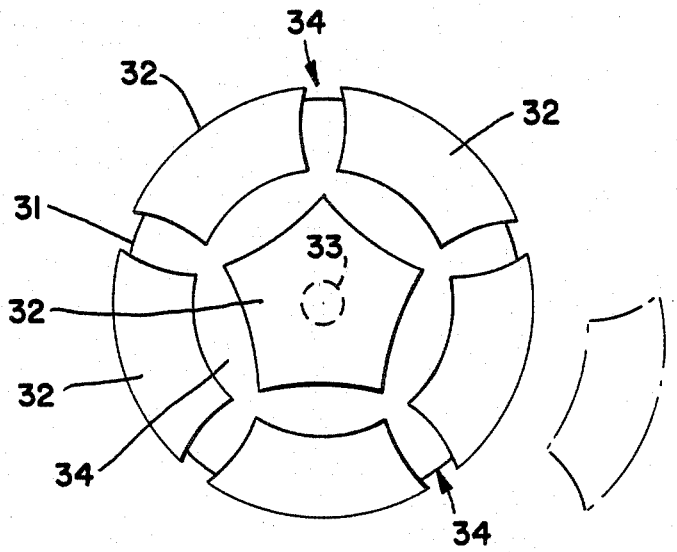
FIG. 8 is a plan view of the base member of the present invention, including the pentagonal members secured thereto.
Figure 9:
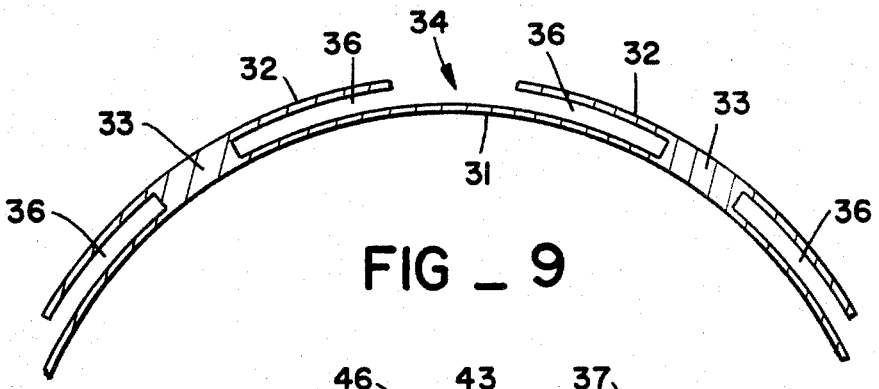
FIG. 9 is an enlarged cross-sectional view of the base member as depicted in FIG. 8.

The puzzle toy 21 includes a base member 31 which is formed as a hollow spherical member, as shown in FIG. 8. It also includes twelve pentangle members 32 which are equally spaced about the exterior surface of the sphere 31. As shown in FIG. 9, each pentangle member 32 is joined to the surface of the sphere 31 by a cylindrical extension 33 extending radially inwardly from the medial portion of each pentangle member 32. The members 32 are thus disposed in spaced apart relationship with respect to the surface of the sphere 31, the members 32 defining with the sphere 31 a plurality of gaps 36 disposed therebetween. The confronting edge portions of adjacent pentangle members 32 are disposed in spaced apart relationship to define therebetween a continuous network of channel-like tracks 34 which extend continuously about the sphere 31. Each of the pentangle members is quite similar to a regular pentagon, except that each member 32 is curved to conform to a segment of a sphere, rather than a segment of a plane. Furthermore, the edge portions of each pentangle member are curved slightly to define a segment of a circle rather than the straight edge of a regular pentagon.

The puzzle toy 21 also includes a plurality of tile members 37, as shown in FIGS. 4–7. Each tile member 37 includes an equilateral triangular panel 38 which has an outer surface corresponding to one of the facets 22 of the icosahedron. Extending radially inwardly from each tile member 37 is an annular lip 39 which is disposed concentrically about the axis of symmetry of the equilateral triangle. The peripheral annular surface 41 of the lip 39 is inclined at an angle of approximately 69° with respect to a tangent to the surface of the base member, while the inner circumferential surface is provided with a chamfered edge 42. It may be appreciated that for any regular icosahedron, the concave angle between any two adjacent surfaces is approximately 138°, which is twice 69°. The annular lip 39 defines a cylindrical recess 43 in the underside of each tile member 37. Disposed in each recess 43 is a disc-like member 44 which is generally circular in configuration and curved to correspond to a segment of a sphere having a radius approximately equal to the radius of the base member 31. A pin 46 extends from the member 44 to the tile member 37 along the axis of symmetry of the latter to join the member 44 to the tile. It may be appreciated that there is a narrow opening defined between the chamfered edge 42 of the lip 39 and the peripheral edge of the member 44. The peripheral edge of the member 44 extends slightly below the plane of the lip 39.

The edge portions of the panel 38 are beveled so as to maximize the impinging surfaces of adjacent tile members. For example, the medial edge portions 47 of each tile member are beveled at an angle of approximately 69° with respect to a tangent to the surface of the base member, the same angle of inclination as the surface 41. However, the distal edge portions 48 of each tile member, those portions which are adjacent to the vertices thereof, are beveled at an angle of approximately 48° with respect to a tangent to the surface of the base member.

Figure 10:
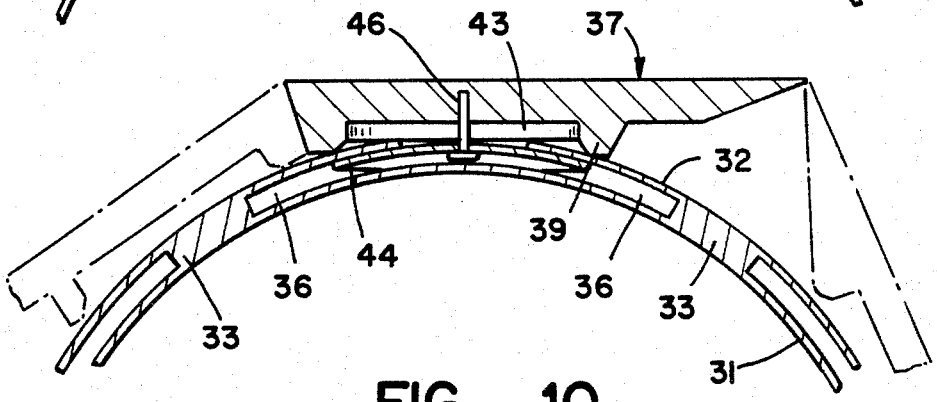
FIG. 10 is an enlarged cross-sectional view of the engagement of the tile members with the base member as shown in FIG. 9.
Figure 11:
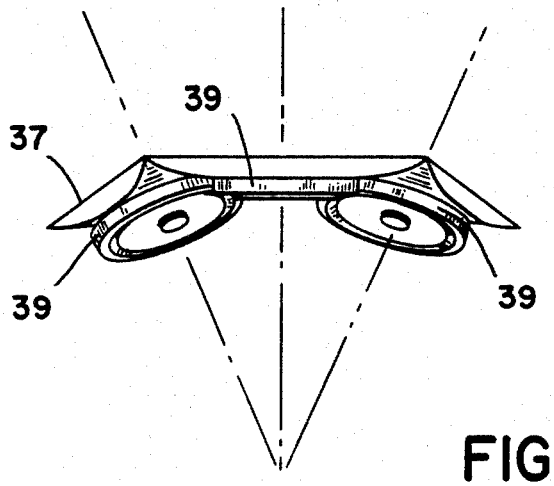
FIG. 11 is a detailed perspective view showing the mutual engagement of adjacent tile members.

With reference to FIGS. 9 and 10, the tile members 37 are disposed about the surface of the spherical base member 31. The disk member 44 of each tile 37 is slidably disposed within the gaps 36 defined by the members 32 and the surface of the base 31. Due to the fact that the members 44 are substantially wider than the tracks 34, the tiles 37 are secured to the outer surface of the member 31 in permanent, translatable fashion. The pin 46 extends upwardly from the member 44, through the track 34, and is received in the tile 46. When all of the tiles are thus joined to the base member 31, the ringed portions 39 which depend from the tile members 37 are brought into slidable impingement with the ring members of adjacent tiles, as shown in FIG. 11, due to the 69° bevel of the outer surfaces of the portions 39. The beveled edges of the tile members are also substantially fully impinging on the edges of adjacent tile members, the angle of the bevel being selected to achieve this result. It may be appreciated that the impingement of the adjacent ring members 39, as well as the impingement of opposed edge portions of adjacent tile members serves to constrain the motion of the tile members to two possible movements. Any five tile members which join at a common vertex may be rotated in concert about that vertex. Each tile member may also be rotated about its own midpoint, with no translation of the tile member, so as to dispose the tile member in a different orientation without changing its position in the puzzle.

To increase the complexity of the solution of the puzzle, the tile members can be configured so that they may be translated in groups of five about a common vertex but may not be individually rotated about their midpoints. As shown in FIG. 19, the annular lip 39 which extends inwardly from each tile member may be formed as a trilateral shape in which the ring is provided with three lobes 51 which extend generally laterally outwardly toward the vertices of the respective tile member. The mutual engagement of the lobes 51, as shown in FIG. 19, prevent rotation of individual tile members while providing the desired spacing effect between the tile members and also permitting translation thereof in the tracks 34.

The tile members 37 may be provided with surface features which enhance their ability to be manipulated manually. For example, as shown in FIG. 12*a*, each tile member 37*a* may be provided with a small cylindrical knob 53 extending outwardly from the outer surface of the tile and disposed approximately concentrically with the midpoint thereon. Alternatively, as shown in FIG. 12*b*, a tile 37*b* may be provided with a generally cylindrical depression 54 formed in the surface of the tile and disposed generally concentrically about the midpoint thereof. In a further embodiment, shown in FIG. 12*c*, a tile 37*c* may be provided with finger grips 56 formed in the edge portions thereof. The finger grips 56 comprise arcuate recesses formed in the medial portions of the edges of the tile member and disposed so that the finger grips 56 of adjacent tile members are disposed in confronting, adjacent relationship. Two finger grips 56 in adjacent relationship provide sufficient opening for the finger tips to engage a tile member to achieve rotation or translation thereof.

A further embodiment of the puzzle toy of the present invention, as shown in FIG. 15, comprises a stellated version of the icosahedral embodiment discussed previously. In the stellated embodiment, the construction of the base member 31 and the pentangle member 32 is substantially the same as that described previously. Likewise, each tile member 37 includes the same features as shown in FIGS. 4, 5, 6 and 7; i.e., the annular lip 39, the member 44, the beveled surfaces 47 and 48, and the same general triangular shape. However, as shown in FIG. 16, the tiles of the stellated puzzle each include a pyramid 58 formed integrally atop the tile member 37. The pyramid 58 comprises three triangular surfaces extending upwardly from the tile 37 and joined at a common vertex which is coaxial with the midpoint of the tile. Each edge of the tile is coincident with one lower edge of a facet of the pyramid 58.

The height of the pyramid 58 is not a critical dimension. However, if the height is selected appropriately, each pyramid 58*a* (FIG. 15) will have adjacent to it facets 59*a* of the adjacent pyramids, the facets 59*a* being disposed in a common plane which is coplanar with the base of the pyramid 58*a*. In this special case, known in the prior art as the triakis icosahedron, each pyramid 58*a* may be rotated about its midpoint to achieve rotation of the tile without translation thereof. Alternatively, the pyramids 58 may be fashioned with a height greater than that shown in FIG. 15. In this latter case, the adjacent surfaces 59 would form a concave recess in which the pyramids 58*a* are disposed, and the pyramids 58*a* would thus be prevented from undergoing rotation about their respective axes. Thus in the latter case, rotation would be blocked without recourse to the lobed rings 51 shown in FIG. 19. However, the translation of tiles in groups of five about a common vertex would still provide a means or rearranging the tile members to solve the puzzle.

With reference to FIGS. 17 and 18, a further embodiment of the present invention is configured with the outer surfaces of a rhombicosidodecahedron, i.e., a polyhedron comprised of twelve pentangular facets 61, thirty rectangular facets 62, and twenty triangular facets 63. As shown in FIG. 17, each pentangular facet 61 is surrounded by five rectangular facets 62, each adjacent to one side of the pentangle, and five triangular facets 63, each disposed between two adjacent rectangular segments and having one triangular vertex joining a vertex of the pentangular facet. (In a special case of this arrangement of rectangular facets are square, the triangular segments are relatively larger, and the pentagonal facets are relatively smaller than shown in FIG. 17.) In this embodiment of the present invention, the pentangular segments 61 are rotatable about their centerpoints, but are not translatable about the solid figure. The facets 62 and 63 which surround a given pentangular facet 61 will rotate in concert with that facet. It may be appreciated that each of the twenty triangular facets is disposed at the intersection of three rotating facet systems, while each rectangular facet 62 is disposed within only two separate rotating systems. When any facet is translated by rotation of an adjacent pentangular facet, it enters a new rotational system of a differing pentangular segment, and may be translated within that new system by rotation of that new pentangular segment. Thus the segments 62 and 63 may travel complex and circuitous paths about the periphery of the solid. As in the previous embodiments, the facets may be provided with surface indicia which are to be brought into a predetermined pattern or conjunction in order to solve the puzzle.

As shown in FIG. 18, the rhombicosidodecahedral embodiment of the present invention includes a base member 64 which is hollow and spherical in configuration. Extending outwardly from the surface of the base 64 are twelve cylindrical protrusions 66. The protrusions 66 extend outwardly from the surface a small distance, and they are spaced at equal solid angles about the periphery of the sphere 64. Each of the protrusions 66 includes a cylindrical hole extending therethrough and disposed along a diameter of the sphere 64.

The twelve pentangular facets 61 are formed by twelve tiles 67, each having an outer surface configured as a planar regular pentagon. Extending inwardly from the midpoint of each tile 67 is a cylindrical post 68 which is received within one of the holes extending through one of the cylindrical protrusions 66. The inner ends of the members 68 may be provided with a laterally extending flange, snap ring, or the like to retain the tiles 67 in their rotatable engagement with the members 66.

Each of the rectangular facets 62 are defined by one of a plurality of tile members 69, the outer surfaces of the tile members 69 being configured as rectangles. A short cylindrical post 71 extends inwardly from each tile 69 to space the tile from the base member 64 so as to support the tile with the outer surface thereof in edge adjacent relationship to the pentangular tile members 67. It may be appreciated that two parallel edges of each rectangular member abut adjacent pentangular members 67. Extending laterally from these parallel edges at the inner end of each tile 69 is a flange member 72. The flange member 72 is provided to engage the undersides of the tiles 67 and to retain the tiles 69 within the assembly. The flange members 72 permit free translation of the tiles 69 in any direction. It may be appreciated that the engagement of the edges of the tiles 69 and 67 determine that each tile 69 will translate as an adjacent tile 67 is rotated. The other two parallel sides of each rectangular member abut the adjacent triangular members, and do not have flanges protruding laterally from beneath them.

The triangular facets 63 are defined by tile members which are similar in construction to the tile member 69, but with an outward surface configuration of an equilateral triangle. The edges of each triangular tile member abut adjacent rectangular tiles, and include flanges extending laterally outwardly therefrom to be retained beneath the adjacent rectangular tile members. The engagement of the triangular tile members with the rotatable tiles 67 is substantially the same as shown for the engagement of the edges of the tiles 69 and the tile members 67.

A further embodiment of the present invention, shown in FIGS. 20 and 21, provides a puzzle which has the outward appearance of a sphere. The outer surface is defined by twelve pentangular facets 81 and thirty lenticular facets 82, each member 81 being surrounded by five lenticular facets. As in the previous embodiment, the pentangular facets are rotatable and not translatable, and each lenticular facet may rotate with either of the pentangular facets to which it is adjacent. Thus the lenticular facets may be moved about the sphere and rearranged to effect a solution of the puzzle.

As shown in FIG. 21, the spherical embodiment of the present invention includes a base member 84 which is hollow and spherical in configuration. Extending outwardly from the surface of the base 84 are twelve cylindrical protrusions 86. The protrusions 86 extend outwardly from the surface a small distance, and they are spaced at equal solid angles about the periphery of the sphere 84. Each of the protrusions 86 includes a cylindrical hole extending therethrough and disposed along a diameter of the sphere 84.

The twelve pentangular facets 81 are formed by twelve tile members 87, each having a curved outer surface configured as a section of a sphere which is concentric with the spherical base member 84. Each pentangular member includes five equilateral sides which are curved concavely. Extending inwardly from the midpoint of each tile 87 is a cylindrical post 88 which is received within one of the holes extending through one of the cylindrical protrusions 86. The inner ends of the members 88 may be provided with a laterally extending flange, snap ring, or the like to retain the tiles 87 in their rotatable engagement with the members 86.

Each of the lenticular facets 82 are defined by one of a plurality of tile members 89, the two opposed edges of each tile member 89 being configured as convex curves which meet at opposed vertices. The curve of the edges is complementary to the concave curve of the edges of the pentangular members 87. Extending laterally from each of the members 89 are flanges 91 which are received and retained in slidable fashion beneath the edges of the members 87. The engagement of the complementary curved edges of the members 87 and 89 determines that the lenticular members will be caused to translate as either adjacent pentangular member is rotated.

It should be noted that the embodiment depicted in FIGS. 20 and 21 bears many similarities in construction to the embodiment depicted in FIGS. 17 and 18. Indeed, the tiles 67 and 87 correspond closely in their components 66-68 and 86-88, the tiles 67 each including in addition an outer planar panel. The tiles 69 and 89 bear the same similarities in construction, with the addition of an outer planar panel secured to each of the tiles 69. These structural similarities may be exploited for purposes of simplifying manufacturing of the invention. components It may be appreciated that the puzzle toy of the present invention is not limited by the specific embodiments shown and described herein. Furthermore, the various features of the embodiments may be combined within the teachings of the invention. For example, a further spherical embodiment of the puzzle toy, shown in FIG. 22, may comprise a spherical version of the rhombicosadodecahedron. This embodiment includes tiles 102 having curved rectangular facets, as well as tiles 103 having curved triangular facets, in addition to tiles 101 having curved pentangular facets. The edges of the pentangular tiles 101 are arcuate and concave, as in the previous embodiment, while the longer pair of edges of each rectangular tile 102 are arcuate and convex in a manner complementary to the pentangular edges. The edges of the triangular tiles are arcuate and convex to engage the concave shorter edges of the rectangular tiles in complementary fashion. The structure beneath the outer surfaces of the tiles is substantially as shown in FIG. 21. As before, the tiles 101 are rotatable, and the tiles 102 and 103 are translatable in concert with rotation of a tile 101 adjacent thereto.

Likewise, other features of the invention may be combined advantageously. The planar faceted embodiments of FIGS. 17 and 18, for example, may be provided with outwardly extending surface features, such as the pyramid tile members disclosed herein. Also, the spherical embodiments of FIGS. 20-22 may be provided with surface relief features, such as geographic relief, as in the case of a globe design, or lunar craters, in the case of a lunar model, or the like.

I claim:

1. A manually actuated puzzle toy, comprising a base member having a continuous, closed curved surface, a plurality of tile members adapted to be secured to said base member, track means formed on said surface, means on said tile members to engage said track means in translatable and rotatable fashion, said tile members having substantially identical outer edge configurations, each of said tile members including linear edge portions disposed to impinge upon like linear edge portions of adjacent tile members, a like plurality of triangular pyramids, each of said triangular pyramids extending outwardly from one of said tile members.

2. The puzzle toy of claim 1, wherein said pyramids define a stellated icosahedron.

3. The puzzle toy of claim 1, wherein said pyramids define a triakis icosahedron.

4. The puzzle toy of claim 1, wherein each of said linear edge portions of each tile member comprises a lower edge of the respective pyramid of the tile member.

5. The puzzle toy of claim 1, wherein said pyramids are equal in height, said height being sufficient to cause interference between opposed pyramid facets of adjacent tile members and prevent rotation of adjacent tile members.

6. The puzzle toy of claim 1, wherein said pyramids are equal in height, said height being sufficiently small to provide clearance between opposed pyramid facets of adjacent tiles and permit rotation of adjacent tile members.

* * * * *